US009035863B2

(12) United States Patent
Ban et al.

(10) Patent No.: US 9,035,863 B2
(45) Date of Patent: May 19, 2015

(54) LIQUID CRYSTAL DISPLAY DATA DRIVER CAPABLE OF COLUMN INVERSION AND 3-COLUMN INVERSION DRIVING METHOD

(75) Inventors: Young-Il Ban, Hwaseong-si (KR); Jong Min Lee, Suwon-si (KR); Sun Kyu Son, Suwon-si (KR); Ok-Kwon Shin, Asan-si (KR); Jae-Han Lee, Asan-si (KR)

(73) Assignee: SAMSUNG DISPLAY CO., LTD. (KR)

( * ) Notice: Subject to any disclaimer, the term of this patent is extended or adjusted under 35 U.S.C. 154(b) by 425 days.

(21) Appl. No.: 13/206,865

(22) Filed: Aug. 10, 2011

(65) Prior Publication Data

US 2012/0249603 A1 Oct. 4, 2012

(30) Foreign Application Priority Data

Mar. 28, 2011 (KR) ..... 10-2011-0027612

(51) Int. Cl.
*G09G 3/36* (2006.01)

(52) U.S. Cl.
CPC ..... *G09G 3/3614* (2013.01); *G09G 3/3688* (2013.01); *G09G 2300/0408* (2013.01); *G09G 2310/0297* (2013.01)

(58) Field of Classification Search
CPC ..... G09G 3/3614; G09G 3/3688
USPC ..... 345/88, 96
See application file for complete search history.

(56) References Cited

U.S. PATENT DOCUMENTS 6,166,725 A 12/2000 Isami et al.
6,307,531 B1 * 10/2001 Shin ..... 345/88
6,388,653 B1 5/2002 Goto et al.
6,518,946 B2 2/2003 Ode et al.
6,580,411 B1 6/2003 Kubota et al.
6,756,961 B2 6/2004 Hector et al.
6,791,526 B2 9/2004 Kubota et al.
6,831,624 B1 * 12/2004 Harrold ..... 345/98
6,870,524 B2 3/2005 Katsutani
6,914,592 B2 7/2005 Miyazawa et al.
6,982,692 B2 1/2006 Kim
7,079,097 B2 7/2006 Lee
7,710,374 B2 5/2010 Lee
2003/0090451 A1 * 5/2003 Ahn ..... 345/96
2004/0104873 A1 * 6/2004 Kang et al. ..... 345/87
2004/0104880 A1 * 6/2004 Kang et al. ..... 345/94

(Continued)

FOREIGN PATENT DOCUMENTS

JP 11282008 10/1999
JP 2003114655 4/2003

(Continued)

*Primary Examiner* — Claire X Pappas
*Assistant Examiner* — Robert Stone
(74) *Attorney, Agent, or Firm* — Cantor Colburn LLP

(57) ABSTRACT

A liquid crystal display includes a plurality of pixels, a plurality of data lines connected to the plurality of pixels, and a data driver connected to the plurality of data lines, where the data driver supplies data voltage to the plurality of data lines, where the data driver includes a data latch which outputs input image data in response to image data corresponding to the plurality of pixels, wherein the data latch rearranges a sequence of the image data, and a digital-to-analog converting unit which includes a positive digital-to-analog converter which generates a positive data voltage in response to the input image data, and a negative digital-to-analog converter which generates a negative data voltage in response to the input image data.

20 Claims, 10 Drawing Sheets

(56) References Cited

U.S. PATENT DOCUMENTS

| | | | | |
|---|---|---|---|---|
| 2004/0125067 | A1* | 7/2004 | Kim et al. | 345/98 |
| 2006/0007213 | A1* | 1/2006 | Hashimoto et al. | 345/204 |
| 2006/0028422 | A1 | 2/2006 | Jung | |
| 2007/0229447 | A1* | 10/2007 | Takahara et al. | 345/102 |
| 2008/0158215 | A1 | 7/2008 | Lee | |
| 2008/0180378 | A1 | 7/2008 | Tang | |
| 2008/0204386 | A1* | 8/2008 | Park | 345/84 |
| 2008/0204391 | A1* | 8/2008 | Yi | 345/88 |
| 2009/0015574 | A1* | 1/2009 | Kim et al. | 345/208 |
| 2009/0251629 | A1 | 10/2009 | Ito et al. | |
| 2012/0299983 | A1* | 11/2012 | Chang et al. | 345/691 |
| 2013/0241960 | A1* | 9/2013 | Xu et al. | 345/690 |

FOREIGN PATENT DOCUMENTS

| | | |
|---|---|---|
| JP | 3464599 | 8/2003 |
| JP | 4291643 | 4/2009 |
| JP | 2009069423 | 4/2009 |
| KR | 100231358 | 8/1999 |
| KR | 100338007 | 5/2002 |
| KR | 1020060077952 | 7/2006 |
| KR | 1020080001052 | 1/2008 |
| KR | 1020080023594 | 3/2008 |
| KR | 1020080081516 | 9/2008 |
| KR | 100936197 | 1/2010 |

* cited by examiner

FIG. 1

| Frame | Gate line | Selection signal | | Data line | | | | | | |
|---|---|---|---|---|---|---|---|---|---|---|
| | | SEL1 | SEL2 | D1 | D2 | D3 | D4 | D5 | D6 | D7 |
| N | G1 | L | H | R- | G+ | B- | R+ | G- | B+ | R- |
| | G2 | L | H | R- | G+ | B- | R+ | G- | B+ | R- |
| | G3 | L | H | R- | G+ | B- | R+ | G- | B+ | R- |
| | G4 | L | H | R- | G+ | B- | R+ | G- | B+ | R- |
| | G5 | L | H | R- | G+ | B- | R+ | G- | B+ | R- |
| | : | L | H | R- | G+ | B- | R+ | G- | B+ | R- |
| N+1 | G1 | L | L | R+ | G- | B+ | R- | G+ | B- | R+ |
| | G2 | L | L | R+ | G- | B+ | R- | G+ | B- | R+ |
| | G3 | L | L | R+ | G- | B+ | R- | G+ | B- | R+ |
| | G4 | L | L | R+ | G- | B+ | R- | G+ | B- | R+ |
| | G5 | L | L | R+ | G- | B+ | R- | G+ | B- | R+ |
| | : | L | L | R+ | G- | B+ | R- | G+ | B- | R+ |

FIG. 2

| Frame | Gate line | Selection signal | | Data line | | | | | | |
|---|---|---|---|---|---|---|---|---|---|---|
| | | SEL1 | SEL2 | D1 | D2 | D3 | D4 | D5 | D6 | D7 |
| M | G1 | H | H | R- | G- | B- | R+ | G+ | B+ | R- |
| | G2 | H | H | R- | G- | B- | R+ | G+ | B+ | R- |
| | G3 | H | H | R- | G- | B- | R+ | G+ | B+ | R- |
| | G4 | H | H | R- | G- | B- | R+ | G+ | B+ | R- |
| | G5 | H | H | R- | G- | B- | R+ | G+ | B+ | R- |
| | : | H | H | R- | G- | B- | R+ | G+ | B+ | R- |
| M+1 | G1 | H | L | R+ | G+ | B+ | R- | G- | B- | R+ |
| | G2 | H | L | R+ | G+ | B+ | R- | G- | B- | R+ |
| | G3 | H | L | R+ | G+ | B+ | R- | G- | B- | R+ |
| | G4 | H | L | R+ | G+ | B+ | R- | G- | B- | R+ |
| | G5 | H | L | R+ | G+ | B+ | R- | G- | B- | R+ |
| | : | H | L | R+ | G+ | B+ | R- | G- | B- | R+ |

Frame N

Frame N+1

Frame M

Frame M+1

Frame M

Frame M+1

LIQUID CRYSTAL DISPLAY DATA DRIVER CAPABLE OF COLUMN INVERSION AND 3-COLUMN INVERSION DRIVING METHOD

This application claims priority to Korean Patent Application No. 10-2011-0027612, filed on Mar. 28, 2011, and all the benefits accruing therefrom under 35 U.S.C. §119, the e content of which in its entirety is herein incorporated by reference.

BACKGROUND OF THE INVENTION (a) Field of the Invention

The present disclosure relates to a liquid crystal display.

(b) Description of the Related Art

A liquid crystal display, which is one of widely used types of flat panel display, typically includes two display panels on which a field generating electrode, such as a pixel electrode and a common electrode, is disposed and a liquid crystal layer interposed between the two display panels. The liquid crystal display generates an electric field in the liquid crystal layer by applying voltage to the field generating electrode to determine orientations of liquid crystal molecules of the liquid crystal layer and control polarization of incident light, thereby displaying an image.

The liquid crystal display generally includes a pixel including a switching element, typically implemented as a thin film transistor ("TFT") that is a 3-terminal element, and a display panel provided with display signal lines such as a gate line and a data line. The TFT serves as the switching element that transfers or interrupts data voltage transferred through the data line to a pixel based on a gate signal transferred through the gate line.

A liquid crystal capacitor includes a pixel electrode and a common electrode as two terminals, and the liquid crystal layer interposed between the two electrodes serves as a dielectric material. Charge voltage of the liquid crystal capacitor, i.e., pixel voltage, is determined by a difference between the data voltage applied to the pixel electrode and the common voltage applied to the common electrode. Orientations of liquid crystal molecules vary depending on the magnitude of the pixel voltage, and polarization of light passing through the liquid crystal layer thereby varies. The polarization variation is shown as variation of transmittance of light by a polarizer attached to the liquid crystal display, and the pixel thereby displays luminance corresponding to a gray of an image signal.

The polarity of the data voltage may be positive or negative. The polarity of the data voltage represents the polarity of the data voltage with respect to the common voltage. The positive data voltage is data voltage of (+) with respect to the common voltage, and the negative data voltage is data voltage of (−) with respect to the common voltage.

When the liquid crystal display is driven, an inversion driving, in which data voltage having a polarity opposite to a polarity of data voltage applied in a predetermined frame is applied in a subsequent frame, is typically used. The inversion driving method includes a column inversion driving and 3-column inversion driving, for example. The column inversion driving is a driving method in which data voltage inverted every column is applied in each frame, and the 3-column inversion driving is a driving method in which the data voltage having the same polarity is applied to three neighboring columns and the data voltage inverted every three columns is applied.

However, the size of a driving circuit of the liquid crystal display may be increase when the 3-column inversion driving is used, and a manufacturing cost may be thereby increased.

BRIEF SUMMARY OF THE INVENTION

Exemplary embodiments of the invention provide a liquid crystal display using an inversion driving method without increasing the size of a driving circuit.

In an exemplary embodiment of the invention, a liquid crystal display includes: a plurality of pixels; a plurality of data lines connected to the plurality of pixels; and a data driver connected to the plurality of data lines, where the data driver supplies data voltage to the plurality of data lines, and the data driver includes a data latch which outputs input image data in response to image data corresponding to the plurality of pixels, wherein the data latch rearranges a sequence of the image data, and a digital-to-analog converting unit which includes a positive digital-to-analog converter which generates a positive data voltage in response to the input image data, and a negative digital-to-analog converter which generates a negative data voltage in response to the input image data.

According to an exemplary embodiment of the invention, a liquid crystal display is driven using an inversion driving method without increasing the size of a driving circuit.

BRIEF DESCRIPTION OF THE DRAWINGS

The above and other aspects and features of the invention will become more apparent by describing in further detail exemplary embodiments thereof with reference to the accompanying drawings, in which:

FIG. 1 shows a case in which an exemplary embodiment of a liquid crystal display is driven by a column inversion driving method according to the invention;

FIG. 2 shows a case in which an exemplary embodiment of a liquid crystal display is driven by a 3-column inversion driving method according to the invention;

DETAILED DESCRIPTION OF THE INVENTION

Figure 3:
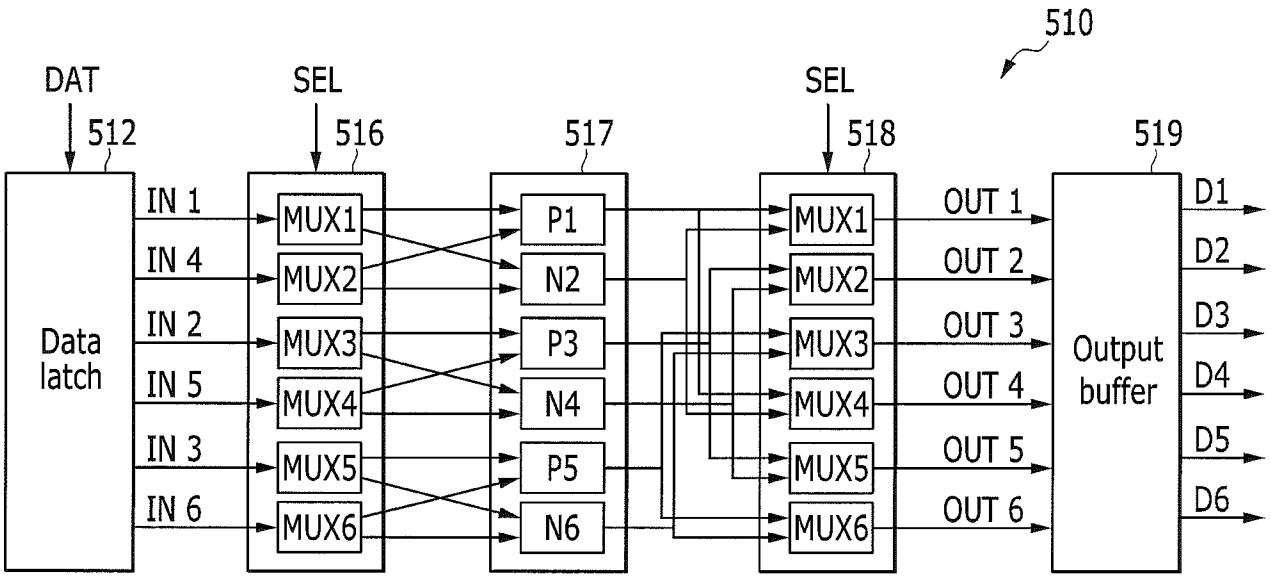
FIG. 3 is a block diagram showing an exemplary embodiment of a data driving integrated circuit of a liquid crystal display according to the invention.

The invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

In the drawings, the thickness of layers, films, panels, areas, etc., are exaggerated for clarity. Like reference numerals designate like elements throughout the specification. It will be understood that when an element such as a layer, film, area, or substrate is referred to as being "on" another element, it can be directly on the other element or intervening elements may also be present. In contrast, when an element is referred to as being "directly on" another element, there are no intervening elements present.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the invention.

Spatially relative terms, such as "lower," "under," "above," "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" or "under" relative to other elements or features would then be oriented "upper" or "above" relative to the other elements or features. Thus, the exemplary term "under" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the invention are described herein with reference to cross-section illustrations that are schematic illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, an exemplary embodiment of a liquid display according to the present invention will be described in detail with reference to the accompanying drawings.

FIG. 1 shows a case in which an exemplary embodiment of a liquid crystal display is driven by a column inversion driving method according to the invention, and FIG. 2 shows a case in which an exemplary embodiment of a liquid crystal display is driven by a 3-column inversion driving method according to the invention.

Referring to FIGS. 1 and 2, the liquid crystal display includes a plurality of pixels arranged in matrix and display signal lines, e.g., a plurality of gate lines G1, G2, . . . , and a plurality of data lines D1, D2, . . . , and the like. Each of the plurality of pixels includes a switching element (not shown), and is electrically connected to a corresponding gate line and a corresponding data line. The gate lines G1, G2, . . . are connected with a gate driver (not shown) to transfer gate voltage that turns on/turns off the switching element. The data lines D1, D2, . . . are connected with a data driver (not shown) to transfer data voltage corresponding to digital image data.

The polarity of the data voltage may be positive or negative. The polarity of the data voltage represents the polarity of the data voltage with respect to common voltage Vcom. The positive data voltage is data voltage of (+) with respect to the common voltage Vcom and the negative data voltage is data voltage of (−) with respect to the common voltage Vcom.

Each of the plurality of pixels corresponds to one among three colors in order to implement a color display. In one exemplary embodiment, for example, three colors may be red R, green G and blue B, but not being limited thereto. Pixels of the same color are arranged on the same column and pixels of three different colors are continuously arranged in a column direction. As shown in FIGS. 1 and 2, a red (R) pixel, a green (G) pixel and a blue (B) pixel may be repeated every three columns, but not being limited thereto.

The liquid crystal display drives the data driver based on a selection signal SEL to transfer data voltage corresponding to the plurality of data lines D1, D2, . . . . The selection signal includes a first selection signal SEL1 and a second selection signal SEL2. The first selection signal SEL1 directs the inversion driving method of the data driver and the second selection signal SEL2 directs a sequence of polarities.

As shown in FIGS. 1 and 2, when the first selection signal SEL1 is low L, the data driver is driven by the column inversion driving method and when the first selection signal SEL 1 is high H, the data driver is driven by the 3-column inversion driving method. In one exemplary embodiment, for example, when the second selection signal SEL2 is high, the polarity of the data voltage of the first data line D1 is negative and when the second selection signal SEL2 is low, the polarity of the data voltage of the first data line D1 is positive. In an alternative exemplary embodiment, the first selection signal SEL1 and the second selection signal SEL2 may be implemented as one selection signal SEL. In one exemplary embodiment, for example, a selection signal of 2 bits may direct both the inversion driving method of the data driver and the sequence of the polarities.

As shown in FIG. 1, the first data line D1 transfers negative data voltage R− in frame N, the second data line D2 transfers positive data voltage G+, the third data line D3 transfers negative data voltage B−, and the data driver is driven by the column inversion driving method. In frame N+1, which is a subsequent frame of frame N, the polarity of the data voltage applied to each of the plurality of pixels is frame-inverted such that the polarity of the data voltage in a current frame, e.g., frame N+1, is opposite to the polarity of the data voltage in a previous frame, e.g., frame N.

In an exemplary embodiment, when the column inversion driving method is used, a column corresponding to one color has a polarity different from polarities of columns corresponding to the other two colors in a three columns corresponding to three colors. As shown in FIG. 1, when the red (R) pixel, the green (G) pixel and blue (B) pixel are repeated every three columns, the polarity of the green (G) pixel has a phase opposite to phases of the red (R) pixel and the blue (B) pixel. In such an embodiment, an amount of a data voltage applied to the green pixel increases, such that greenish may occur. In such an embodiment, the common voltage Vcom (shown in FIG. 9) may be distorted due to asymmetry in amounts of the voltage charged in the pixel.

As shown in FIG. 2, the first data line to the third data line D1 to D3 transfer negative data voltages R−, G− and B− in frame M, and the fourth data line to the sixth data line D4 to D6 transfer positive data voltages R+, G+ and B+. In such an embodiment, the data driver is driven by the 3-column inversion driving method. Frame is inversed in frame M+1 which is the subsequent frame.

In an exemplary embodiment, when the 3-column inversion driving method is used, the polarities of each three columns that correspond to three colors are the same. In such an embodiment, the polarities of the data voltages are maintained in the same phase by the 3-column inversion driving method at each three columns that are continuously arranged corresponding to three colors. In such an embodiment when the 3-column inversion driving method is used, asymmetric charging and greenish may be substantially reduced or effectively prevented.

Figure 4:
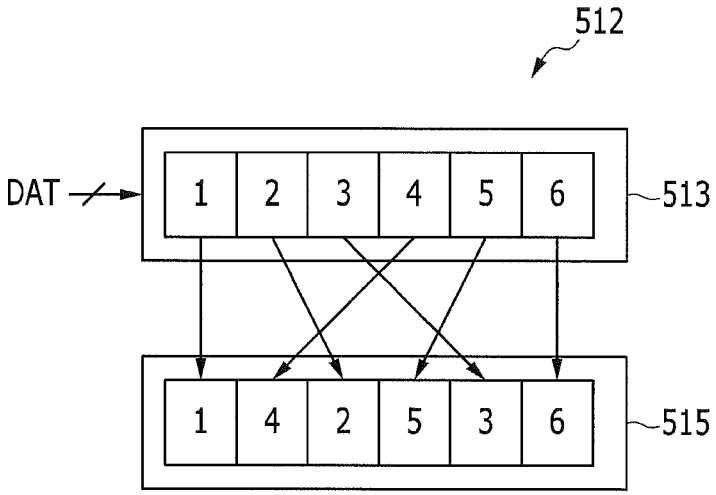
FIG. 4 is a block diagram showing an exemplary embodiment of a data driving integrated circuit of FIG. 3 including a data latch.

Hereinafter, a data driver which drives using both the column inversion driving method and the 3-column inversion driving method will be described referring to FIGS. 3 and 4. In an exemplary embodiment, the data driver may include a plurality of data driving integrated circuits. FIGS. 3 and 4 describe a single data driving integrated circuit for convenience of description.

FIG. 3 is a block diagram showing an exemplary embodiment of a data driving integrated circuit of a liquid crystal display according to the invention, and FIG. 4 is a block diagram showing an exemplary embodiment of a data latch included in the data driving integrated circuit of FIG. 3.

Referring to FIG. 3, the data driving integrated circuit 510 includes a data latch 512, a demultiplexing unit 516, a digital-to-analog converting unit 517, a multiplexing unit 518 and an output buffer 519. The output buffer 519 is connected to a plurality of data lines, e.g. a first to sixth data lines D1, D2, . . . , D6. In FIG. 3, the data driving integrated circuit 510 is shown to be connected to only the first data line D1 to the sixth data line D6 among the plurality of data lines for convenience of description, but the exemplary embodiment is not limited thereto. The data driving integrated circuit of FIGS. 3 and 4 may be similarly applied to the other data lines connected thereto, e.g., the data lines D7, . . . following the sixth data line D6. In such an embodiment, the same data driving integrated circuit may be connected to each of data line sets in which 6 data lines are collected among the plurality of data lines. However, the number of the data lines connected to the data driving integrated circuit 510 is not limited to 6.

The data driving integrated circuit 510 receives digital image data DAT for 6 pixels during a first horizontal period 1H, generates 6 data voltages for 6 pixels, and supplies data voltage to each of 6 data lines D1, D2, . . . , D6. In such an embodiment, 6 pixels are pixels in the same row among the pixels connected to the first data line D1 to the sixth data line D6 in the liquid crystal display. The liquid crystal display applies the data voltage to all the pixels to display an image of one frame by repeating such a process for each row every unit horizontal period 1H.

Referring to FIG. 4, the data latch 512 includes a first latch 513 and a second latch 515. The first latch 513 receives and stores the digital image data DAT for six pixels in sequence and rearranges the sequence of the digital image data DAT corresponding to 6 pixels and sends down the rearranged digital image data DAT to the second latch 515. Hereinafter, in regards to the digital image data DAT for 6 pixels, the digital image data corresponding to a pixel of a first column to a pixel of a sixth column are represented by 1, 2, 3, 4, 5 and 6 in sequence. The first latch 513 rearranges the digital image data DAT for 6 pixels in the sequence of 1, 4, 2, 5, 3 and 6 and sends down the rearranged digital image data DAT to the second latch 515. Since the pixels of the same color are repeated every three columns, the data latch 512 rearranges the sequence of the digital image data for 6 pixels such that the digital image data corresponding to the same color are arranged to be adjacent to each other. In one exemplary embodiment, for example, when the digital image data 1, 2, 3, 4, 5 and 6 of the pixels in the first to sixth columns correspond to R, G, B, R, G and B in sequence, the digital image data 1, 4, 2, 5, 3 and 6 for 6 pixels, the sequence of which is rearranged correspond to a sequence of R, R, G, G, B and B.

In FIG. 4, an exemplary embodiment of the data latch 512 rearranges the sequence of the digital image data DAT for 6 pixels using two latches, but not being limited thereto.

Referring back to FIG. 3, the data latch 512 outputs input digital image data IN1, IN4, IN2, IN5, IN3 and IN6, the sequence of which is rearranged to the demultiplexing unit 516. Herein, IN n (n is a natural number of 1 to 6) represents digital image data of an n-th column among the digital image data DAT for 6 pixels.

The demultiplexing unit 516 includes a plurality of demultiplexers DEMUX1 to DEMUX6 and the multiplexing unit 518 includes a plurality of multiplexers MUX1 to MUX6. The digital-to-analog converting unit 517 includes a plurality of digital-to-analog converters ("DAC") P1, N2, P3, N4, P5 and N6. The digital-to-analog converters include positive digital-to-analog converters P1, P3 and P5 or negative digital-to-analog converters N2, N4 and N6. In the digital-to-analog converting unit 517, the positive digital-to-analog converters P1, P3 and P5 and the negative digital-to-analog converters N2, N4 and N6 are alternatively arranged.

Each of the plurality of demultiplexers DEMUX1 to DEMUX6 is connected with the data latch 512 through one wire. In such an embodiment, each of the plurality of demultiplexers DEMUX1 to DEMUX6 is connected with one positive digital-to-analog converter P1, P3 or P5 and one negative digital-to-analog converter N2, N4 or N6 through two wires. Each of the plurality of demultiplexers DEMUX1 to DEMUX6 receives one input digital image data IN 1, IN 4, IN 2, IN 5, IN 3 or IN 6 from the data latch 512 and outputs the input digital image data IN 1, IN 4, IN 2, IN 5, IN 3 or IN 6 to one digital-to-analog converter among the positive digital-to-analog converter P1, P3 or P5 and the negative digital-to-analog converter N2, N4 or N6 according to the selection signal SEL. In such an embodiment, each of the plurality of demultiplexers DEMUX1 to DEMUX6 is a 1-to-2 demultiplexer that receives one input and selectively outputs one output between two outputs.

The digital-to-analog converting unit 517 receives the input digital image data IN 1 to IN 6 and converts the received input image digital image data IN 1 to IN 6 into data voltage which is an analog signal. The digital-to-analog converters P1, P3 and P5 convert the input digital image data into the positive data voltage and the negative digital-to-analog converters N2, N4 and N6 convert the input digital image data into the negative data voltage.

Each of the plurality of digital-to-analog converters, e.g., a first digital-to-analog converter P1, a second digital-to-analog converter N2, a third digital-to-analog converter P3, a fourth digital-to-analog converter N4, a fifth digital-to-analog converter P5 and a sixth digital-to-analog converter N6, is connected to two of the multiplexers, e.g., a first to sixth multiplexers MUX1-MUX6. Each of the plurality of digital-to-analog converters P1, N2, P3, N4, P5 and N6 transfers the data voltage to the two of the multiplexers connected thereto.

Each of the first digital-to-analog converter P1 and the second digital-to-analog converter N2 is connected to the first multiplexer MUX1 and the fourth multiplexer MUX4, each of the third digital-to-analog converter P3 and the fourth digital-to-analog converter N4 is connected to the second multiplexer MUX2 and the fifth multiplexer MUX5, and each of the fifth digital-to-analog converter P5 and the sixth digital-to-analog converter N6 is connected to the third multiplexer MUX3 and the sixth multiplexer MUX6.

Each of the plurality of multiplexers MUX1 to MUX6 is connected with one positive digital-to-analog converter, e.g., the first, third and fifth digital-to-analog converter P1, P3, or P5, and one negative digital-to-analog converter, e.g., the second, fourth and sixth digital-to-analog converter N2, N4, or N6. In such an embodiment, each of the plurality of multiplexers MUX1 to MUX6 is connected to the output buffer 519.

Each of the plurality of multiplexers MUX1 to MUX6 receives the positive data voltage from one positive digital-to-analog converter P1, P3 or P5 and the negative data voltage from one negative digital-to-analog converter N2, N4 or N6, and outputs to the output buffer 519 one of the output data voltages, e.g., a first to sixth output data voltages OUT1 to OUT6, among the positive data voltages and the negative data voltages based on the selection signal SEL. In such an embodiment, each of the plurality of multiplexers MUX1 to MUX6 is a 2-to-1 multiplexer that selects and outputs one between two inputs.

The output buffer 519 receives the output data voltages, e.g., first to sixth output data voltages OUT1 to OUT6, and supplies the data voltages to the plurality of data lines D1, D2, . . . , D6, respectively.

In an exemplary embodiment, as shown in Table 1 below, the digital-to-analog converters P1, N2, P3, N4, P5 and N6 may be selected as an output by each of the plurality of demultiplexers DEMUX1 to DEMUX6 based on the selection signal SEL, and the digital-to-analog converters P1, N2, P3, N4, P5 and N6 may be selected as an input by each of the plurality of multiplexers MUX1 to MUX6 based on the selection signal SEL.

TABLE 1

| | Selection signal | | Output selection | | | Input Selection | | | |
|---|---|---|---|---|---|---|---|---|---|
| Frame | SEL1 | SEL2 | IN | DEMUX | DAC | DAC | MUX | OUT | POL |
| N | L | H | IN1 | DEMUX1 | N2 | N2 | MUX1 | OUT1 | − |
| | L | H | IN4 | DEMUX2 | P1 | P3 | MUX2 | OUT2 | + |
| | L | H | IN2 | DEMUX3 | P3 | N6 | MUX3 | OUT3 | − |
| | L | H | IN5 | DEMUX4 | N4 | P1 | MUX4 | OUT4 | + |
| | L | H | IN3 | DEMUX5 | N6 | N4 | MUX5 | OUT5 | − |
| | L | H | IN6 | DEMUX6 | P5 | P5 | MUX6 | OUT6 | + |
| N + 1 | L | L | IN1 | DEMUX1 | P1 | P1 | MUX1 | OUT1 | + |
| | L | L | IN4 | DEMUX2 | N2 | N4 | MUX2 | OUT2 | − |
| | L | L | IN2 | DEMUX3 | N4 | P5 | MUX3 | OUT3 | + |
| | L | L | IN5 | DEMUX4 | P3 | N2 | MUX4 | OUT4 | − |
| | L | L | IN3 | DEMUX5 | P5 | P3 | MUX5 | OUT5 | + |
| | L | L | IN6 | DEMUX6 | N6 | N6 | MUX6 | OUT6 | − |
| M | H | H | IN1 | DEMUX1 | N2 | N2 | MUX1 | OUT1 | − |
| | H | H | IN4 | DEMUX2 | P1 | N4 | MUX2 | OUT2 | − |
| | H | H | IN2 | DEMUX3 | N4 | N6 | MUX3 | OUT3 | − |
| | H | H | IN5 | DEMUX4 | P3 | P1 | MUX4 | OUT4 | + |
| | H | H | IN3 | DEMUX5 | N6 | P3 | MUX5 | OUT5 | + |
| | H | H | IN6 | DEMUX6 | P5 | P5 | MUX6 | OUT6 | + |
| M + 1 | H | L | IN1 | DEMUX1 | P1 | P1 | MUX1 | OUT1 | + |
| | H | L | IN2 | DEMUX2 | N2 | P3 | MUX2 | OUT2 | + |
| | H | L | IN3 | DEMUX3 | P3 | P5 | MUX3 | OUT3 | + |
| | H | L | IN4 | DEMUX4 | N4 | N2 | MUX4 | OUT4 | − |
| | H | L | IN5 | DEMUX5 | P5 | N4 | MUX5 | OUT5 | − |
| | H | L | IN6 | DEMUX6 | N6 | MUX6 | MUX6 | OUT6 | − |

Hereinafter, a driving method of a data driver in an exemplary embodiment of the liquid crystal display using an inversion driving method according to the invention will be described referring to Table 1 and FIGS. 5 and 6.

Figure 5:
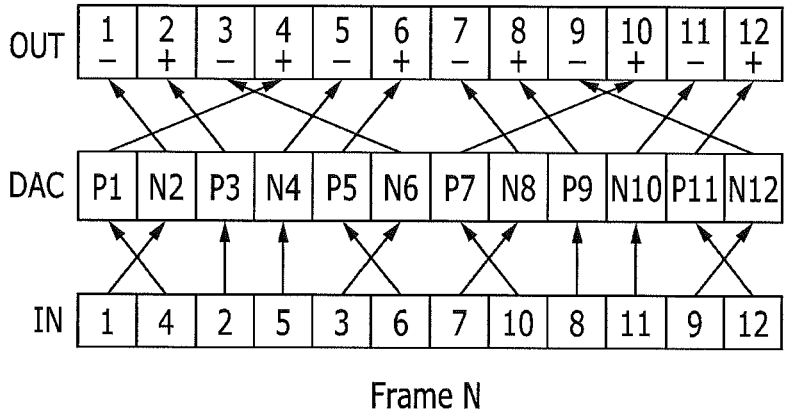
FIG. 5 shows an exemplary embodiment of a driving method of a data driver in frame N and frame N+1 of Table 1.
Figure 5:
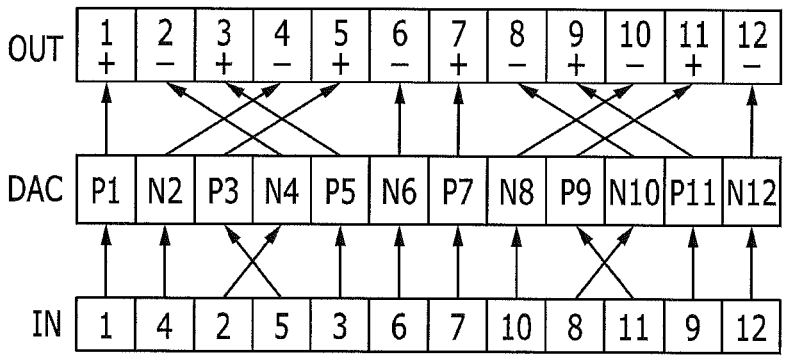
Figure 6:
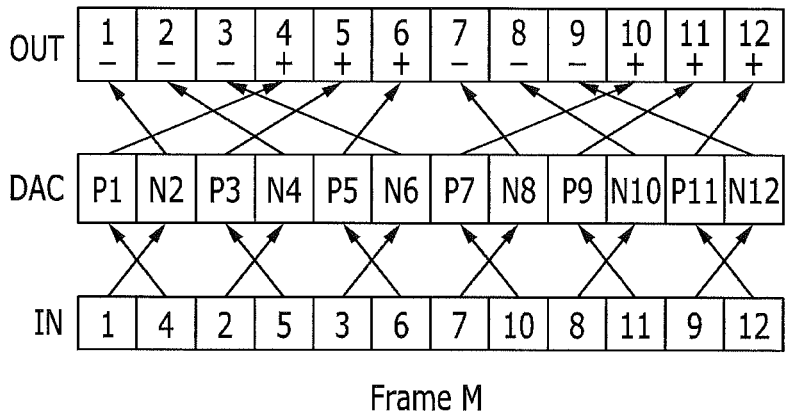
FIG. 6 shows an exemplary embodiment of a driving method of a data driver in frame M and frame M+1 of Table 1.
Figure 6:
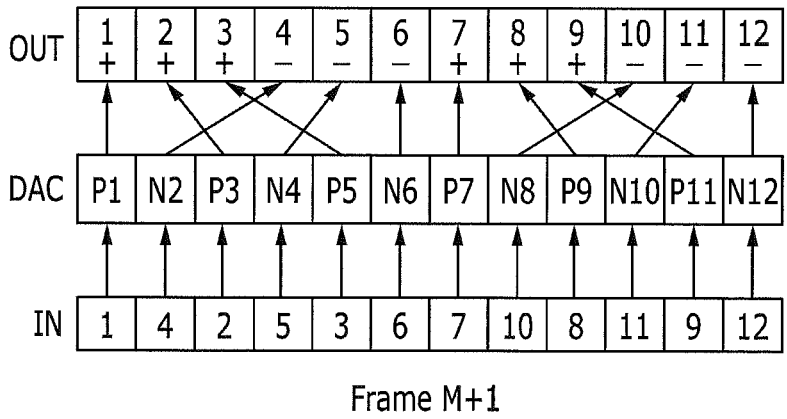

FIG. 5 shows an exemplary embodiment of a driving method of a data driver in frame N and frame N+1 of Table 1, and FIG. 6 shows an exemplary embodiment of a driving method of a data driver in frame M and frame M+1 of Table 1.

FIGS. 5 and 6 show an exemplary embodiment, in which the data driver generates 12 data voltages for 12 pixels during one horizontal period 1H and supplies the data voltage to each of 12 data lines. In such an embodiment, two data driving integrated circuits 510 of FIG. 3 may be used. In FIGS. 5 and 6, 12 data voltages are shown for convenience of description. In an exemplary embodiment, more than 12 data voltages may be generated using a method substantially similar to the method described in FIGS. 5 and 6. In an exemplary embodiment of the data driver, the data voltage generating method for each 6 pixels is substantially the same when each 6 pixels are in a same row and in 6 neighboring columns among the plurality of pixels arranged in a matrix form. In such an embodiment, since a data voltage generation method of 6 initial pixels connected to 6 data lines is substantially the same as a data voltage generating method of subsequent 6 pixels connected to subsequent 6 data lines, only the data voltage generating method for the 6 initial pixels will now be described for convenience of description.

FIG. 5 shows an exemplary embodiment of driving method, in which the data driver is driven by column inversion, and FIG. 6 shows an exemplary embodiment of a driving method, in which the data driver is driven by 3-column inversion.

In an exemplary embodiment of the column inversion driving method shown in FIG. 5, the first input digital image data IN 1 is inputted into the second digital-to-analog converter N2 to be converted into negative first output data voltage OUT1− and outputted to a first data line of a group of 6 data lines in frame N, and inputted into the first digital-to-analog converter P1 to be converted into positive first output data voltage OUT1+ and outputted to the first data line of the group of 6 data lines in frame N+1.

The fourth input digital image data IN 4 is inputted into the first digital-to-analog converter P1 to be converted into positive fourth output data voltage OUT4+ and outputted to a fourth data line of the group of 6 data lines in frame N, and inputted into the second digital-to-analog converter N2 to be converted into negative fourth output data voltage OUT4− and outputted to the fourth data line of the group of 6 data lines in frame N+1.

The second input digital image data IN 2 is inputted into the third digital-to-analog converter P3 to be converted into positive second output data voltage OUT2+ and outputted to a second data line of the group of 6 data lines in frame N, and inputted into the fourth digital-to-analog converter N4 to be converted into negative second output data voltage OUT2− and outputted to the second data line of the group of 6 data lines in frame N+1.

The fifth input digital image data IN 5 is inputted into the fourth digital-to-analog converter N4 to be converted into negative fifth output data voltage OUT5− and outputted to a fifth data line of the group of 6 data lines in frame N, and inputted into the third digital-to-analog converter P3 to be converted into positive fifth output data voltage OUT5+ and outputted to the fifth data line of the group of 6 data lines in frame N+1.

The third input digital image data IN 3 is inputted into the sixth digital-to-analog converter N6 to be converted into negative third output data voltage OUT3− and outputted to a third data line of the group of 6 data lines in frame N, and inputted into the fifth digital-to-analog converter P5 to be converted into positive third output data voltage OUT3+ and outputted to the third data line of the group of 6 data lines in frame N+1.

The sixth input digital image data IN 6 is inputted into the fifth digital-to-analog converter P5 to be converted into positive sixth output data voltage OUT6+ and outputted to a sixth data line of the group of 6 data lines in frame N, and inputted into the sixth digital-to-analog converter N6 to be converted into negative sixth output data voltage OUT6− and outputted to the sixth data line of the group of 6 data lines in frame N+1.

In an exemplary embodiment of the 3-column inversion driving method shown in FIG. 6, the first input digital image data IN 1 is inputted into the second digital-to-analog converter N2 to be converted into the negative first output data voltage OUT1− and outputted to the first data line of the group of 6 data lines in frame M, and inputted into the first digital-to-analog converter P1 to be converted into the positive first output data voltage OUT1+ and outputted to the first data line of the group of 6 data lines in frame M+1.

The fourth input digital image data IN 4 is inputted into the first digital-to-analog converter P1 to be converted into the positive fourth output data voltage OUT4+ and outputted to the fourth data line of the group of 6 data lines in frame M, and inputted into the second digital-to-analog converter N2 to be converted into the negative fourth output data voltage OUT4− and outputted to the fourth data line of the group of 6 data lines in frame M+1.

The second input digital image data IN 2 is inputted into the fourth digital-to-analog converter N4 to be converted into the negative second output data voltage OUT2− and outputted to the second data line of the group of 6 data lines in frame M, and inputted into the third digital-to-analog converter P3 to be converted into the positive second output data voltage OUT2+ and outputted to the second data line of the group of 6 data lines in frame M+1.

The fifth input digital image data IN 5 is inputted into the third digital-to-analog converter P3 to be converted into the positive fifth output data voltage OUT5+ and outputted to the fifth data line of the group of 6 data lines in frame M, and inputted into the fourth digital-to-analog converter N4 to be converted into the negative fifth output data voltage OUT5− and outputted the fifth data line of the group of 6 data lines in frame M+1.

The third input digital image data IN 3 is inputted into the sixth digital-to-analog converter N6 to be converted into the negative third output data voltage OUT3− and outputted to the third data line of the group of 6 data lines in frame M, and inputted into the fifth digital-to-analog converter P5 to be converted into the positive third output data voltage OUT3+ and outputted to the third data line of the group of 6 data lines in frame M+1.

The sixth input digital image data IN 6 is inputted into the fifth digital-to-analog converter P5 to be converted into the positive sixth output data voltage OUT6+ and outputted to the sixth data line of the group of 6 data lines in frame M, and inputted into the sixth digital-to-analog converter N6 to be converted into the negative sixth output data voltage OUT6− and outputted to the sixth data line of the group of 6 data lines in frame M+1.

As described above, when the sequence of the digital image data for 6 pixels is rearranged such that image data corresponding to the same color are adjacent to each other, each digital-to-analog converter includes two outputs. In one exemplary embodiment, for example, the first digital-to-analog converter P1 includes the output to the first data line and the fourth data line of the group of 6 data lines. In such an embodiment, two outputs are included in each digital-to-analog converter to drive the data driver by the column inversion driving method or the 3-column inversion driving method. Accordingly, each of the multiplexers MUX1 to MUX6 of the multiplexing unit 518 of FIG. 3 is the 2-to-1 multiplexer which selects one output between two outputs.

Hereinafter, an exemplary embodiment of a data voltage generating operation according to the inversion driving method of the data driver in which the sequence of the image data is not rearranged will be described with reference to FIGS. 7 and 8.

Figure 7:
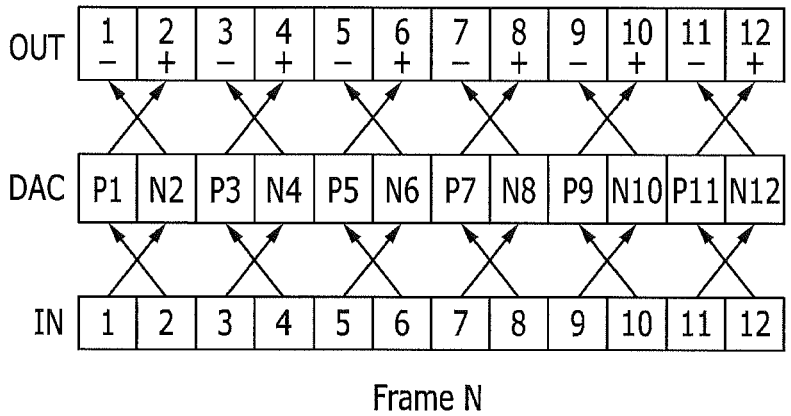
FIG. 7 shows an alternative exemplary embodiment of a driving method of a data driver using column inversion.
Figure 7:
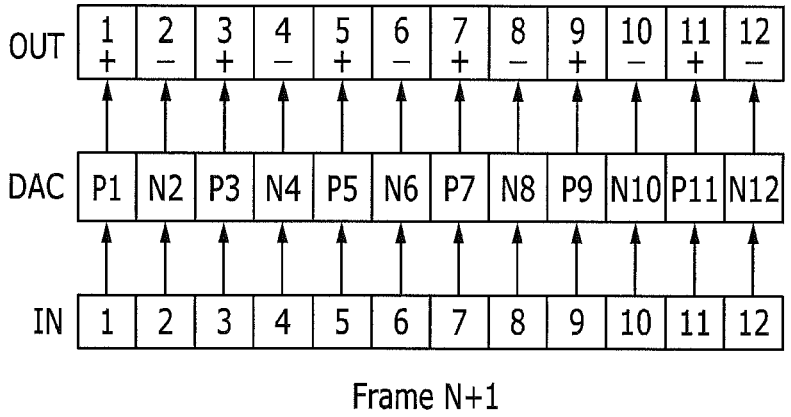
Figure 8:
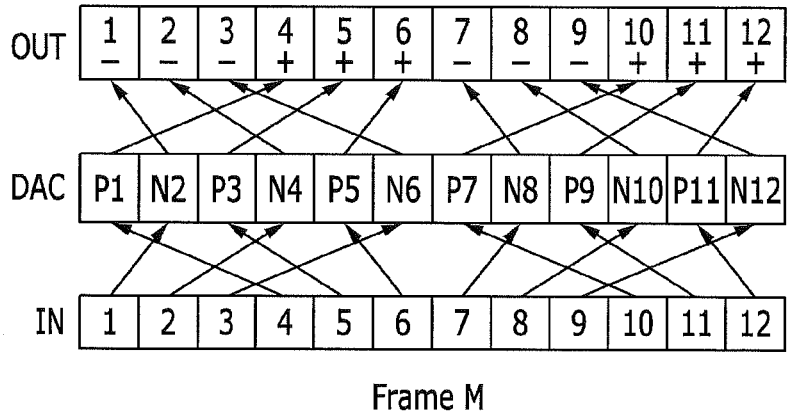
FIG. 8 shows an alternative exemplary embodiment of a driving method of a data driver using 3-column inversion.
Figure 8:
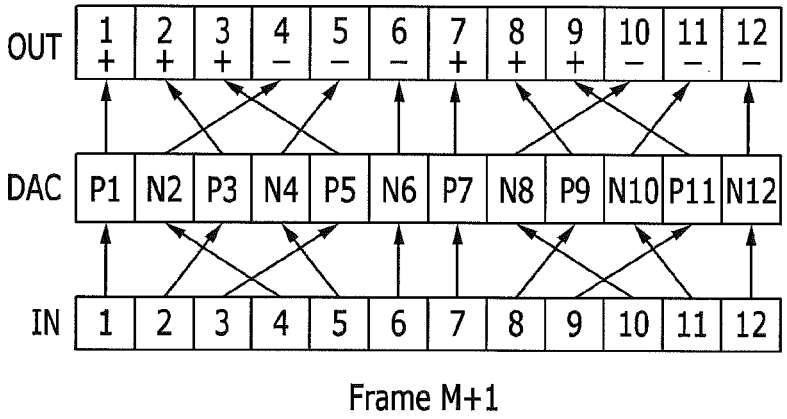

FIG. 7 shows an exemplary embodiment of driving method, in which the data driver is driven by column inversion, and FIG. 8 shows an exemplary embodiment of driving method, in which the data driver is driven by 3-column inversion.

In an exemplary embodiment of the column inversion driving method shown in FIG. 7, the first input digital image data IN 1 is inputted into the second digital-to-analog converter N2 to be converted into the negative first output data voltage OUT1− and outputted to the first data line of the group of 6 data lines in frame N, and inputted into the first digital-to-analog converter P1 to be converted into the positive first output data voltage OUT1+ and outputted to the first data line of the group of 6 data lines in frame N+1.

The second input digital image data IN 2 is inputted into the first digital-to-analog converter P1 to be converted into the positive second output data voltage OUT2+ and outputted to the second data line of the group of 6 data lines in frame N, and inputted into the second digital-to-analog converter N2 to be converted into the negative second output data voltage OUT2− and outputted to the second data line of the group of 6 data lines in frame N+1.

The third input digital image data IN 3 is inputted into the fourth digital-to-analog converter N4 to be converted into the negative third output data voltage OUT3− and outputted to the third data line of the group of 6 data lines in frame N, and inputted into the third digital-to-analog converter P3 to be converted into the positive third output data voltage OUT3+ and outputted to the third data line of the group of 6 data lines in frame N+1.

The fourth input digital image data IN 4 is inputted into the third digital-to-analog converter P3 to be converted into the positive fourth output data voltage OUT4+ and outputted to the fourth data line of the group of 6 data lines in frame N, and inputted into the fourth digital-to-analog converter N4 to be converted into the negative fourth output data voltage OUT4− and outputted to the fourth data line of the group of 6 data lines in frame N+1.

The fifth input digital image data IN 5 is inputted into the sixth digital-to-analog converter N6 to be converted into the negative fifth output data voltage OUT5− and outputted to the fifth data line of the group of 6 data lines in frame N, and inputted into the fifth digital-to-analog converter P5 to be converted into the positive fifth output data voltage OUT5+ and outputted to the fifth data line of the group of 6 data lines in frame N+1.

The sixth input digital image data IN 6 is inputted into the fifth digital-to-analog converter P5 to be converted into the positive sixth output data voltage OUT6+ and outputted to the sixth data line of the group of 6 data lines in frame N, and inputted into the sixth digital-to-analog converter N6 to be converted into the negative sixth output data voltage OUT6− and outputted to the sixth data line of the group of 6 data lines in frame N+1.

In an exemplary embodiment of the 3-column inversion driving method shown in FIG. 8, the first input digital image data IN 1 is inputted into the second digital-to-analog converter N2 to be converted into the negative first output data voltage OUT1− and outputted to the first data line of the group of 6 data lines in frame M, and inputted into the first digital-to-analog converter P1 to be converted into the positive first output data voltage OUT1+ and outputted to the first data line of the group of 6 data lines in frame M+1.

The second input digital image data IN 2 is inputted into the fourth digital-to-analog converter N4 to be converted into the negative second output data voltage OUT2− and outputted to the second data line of the group of 6 data lines in frame M, and inputted into the third digital-to-analog converter P3 to be converted into the positive second output data voltage OUT2+ and outputted to the second data line of the group of 6 data lines in frame M+1.

The third input digital image data IN 3 is inputted into the sixth digital-to-analog converter N6 to be converted into the negative third output data voltage OUT3− and outputted to the third data line of the group of 6 data lines in frame M, and inputted into the fifth digital-to-analog converter P5 to be converted into the positive third output data voltage OUT3+ and outputted to the third data line of the group of 6 data lines in frame M+1.

The fourth input digital image data IN 4 is inputted into the first digital-to-analog converter P1 to be converted into the positive fourth output data voltage OUT4+ and outputted to the fourth data line of the group of 6 data lines in frame M, and inputted into the second digital-to-analog converter N2 to be converted into the negative fourth output data voltage OUT4− and outputted to the fourth data line of the group of 6 data lines in frame M+1.

The fifth input digital image data IN 5 is inputted into the third digital-to-analog converter P3 to be converted into the positive fifth output data voltage OUT5+ and outputted to the fifth data line of the group of 6 data lines in frame M, and inputted into the fourth digital-to-analog converter N4 to be converted into the negative fifth output data voltage OUT5− and outputted to the fifth data line of the group of 6 data lines in frame M+1.

The sixth input digital image data IN 6 is inputted into the fifth digital-to-analog converter P5 to be converted into the positive sixth output data voltage OUT6+ and outputted to the sixth data line of the group of 6 data lines in frame M, and inputted into the sixth digital-to-analog converter N6 to be converted into the negative sixth output data voltage OUT6− and outputted to the sixth data line of the group of 6 data lines in frame M+1.

As described above, when the sequence of the image data is not rearranged, each digital-to-analog converter includes three outputs. In one exemplary embodiment, for example, the first digital-to-analog converter P1 includes the output to the first data line, the second data line and the fourth data line of the group of 6 data lines. In such an embodiment, three outputs are included in each digital-to-analog converter to drive the data driver by the column inversion driving method or the 3-column inversion driving method. In an exemplary embodiment, a 3-to-1 multiplexer that selects one output among three outputs is included.

In such an embodiment, since the size of the 3-to-1 multiplexer is larger than the size of the 2-to-1 multiplexer by approximately 30 to 40%, the size of the data driver increases, net die decreases, and the price of the data driver increases compared to the exemplary embodiment shown in FIGS. 3 to 6.

In an exemplary embodiment shown in FIGS. 3 to 6, the data driver may be driven by the column inversion driving method or the 3-column inversion driving method without increasing the size of the data driver.

Figure 9:
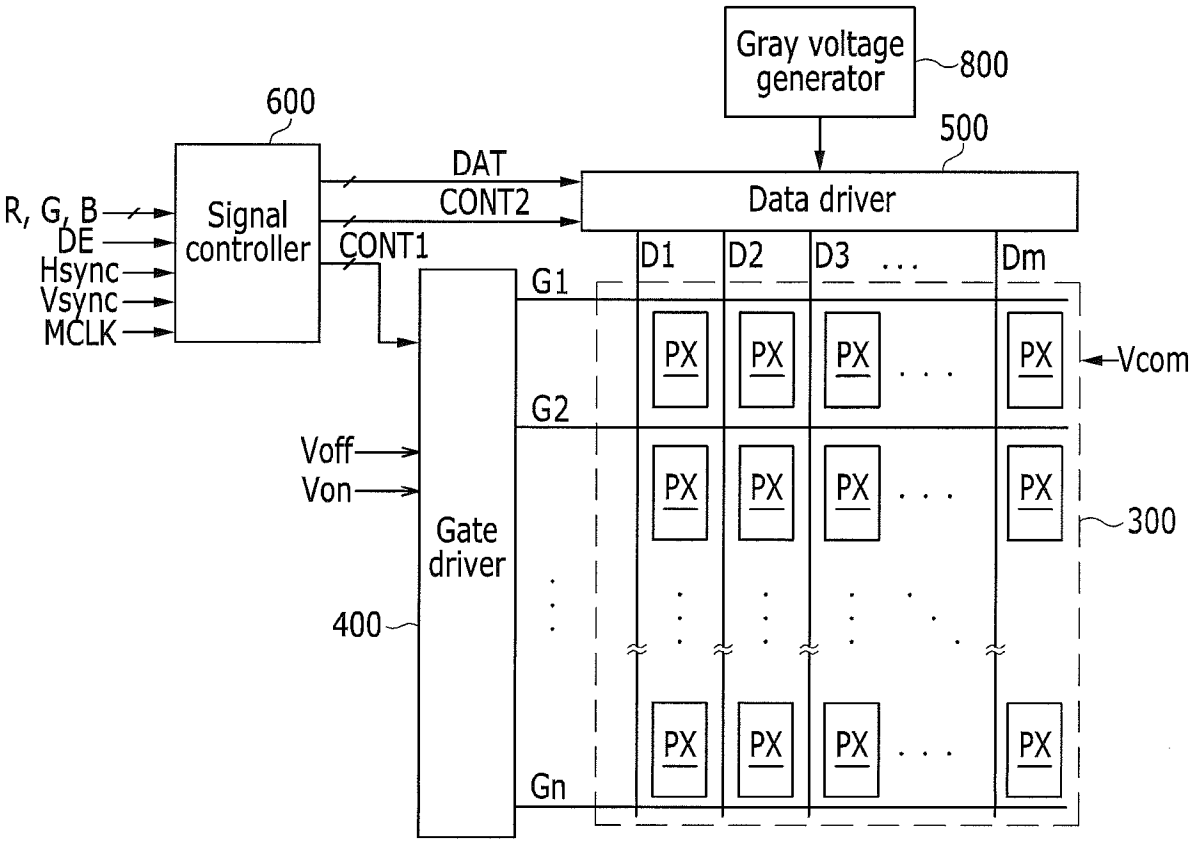
FIG. 9 is a block diagram showing an exemplary embodiment of a liquid crystal display according to the invention.
Figure 10:
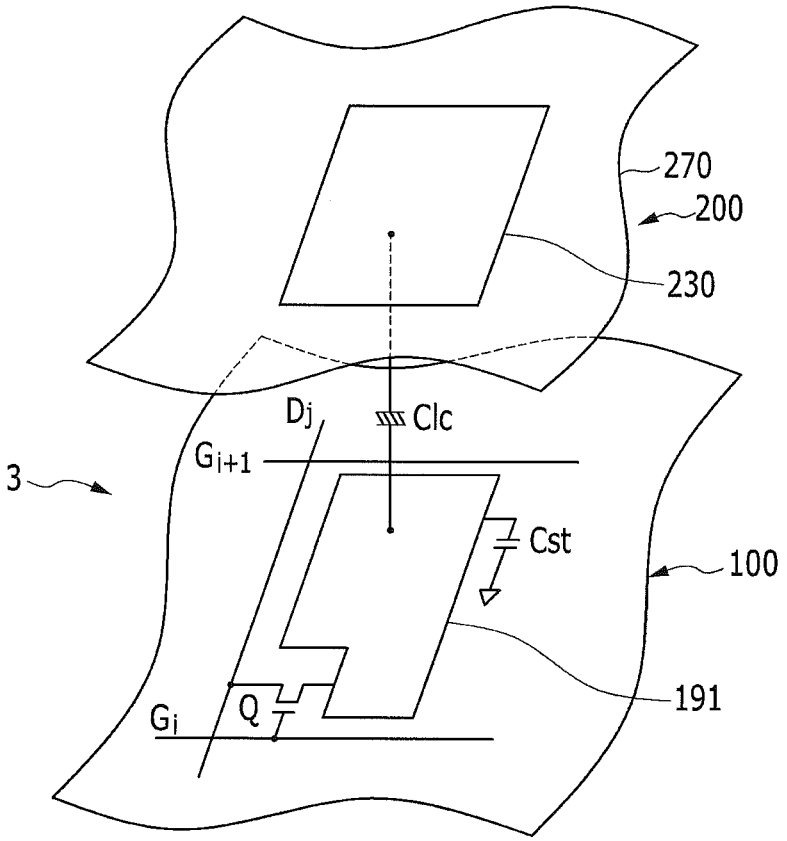
FIG. 10 is an equivalent circuit diagram showing a single pixel in an exemplary embodiment of a liquid crystal display according to the invention.

FIG. 9 is a block diagram showing an exemplary embodiment of a liquid crystal display according to the invention, and FIG. 10 is an equivalent circuit diagram showing a single pixel in an exemplary embodiment of a liquid crystal display according to the invention.

As shown in FIG. 9, an exemplary embodiment of the liquid crystal display includes a liquid crystal panel assembly 300, a gate driver 400 and a data driver 500 connected to the liquid crystal panel assembly 300, a gray voltage generator 800 connected to the data driver 500, and a signal controller 600 which controls the gate driver 400 and the data driver 500.

The liquid crystal panel assembly 300 includes a plurality of signal lines G1 to Gn and D1 to Dm, and a plurality of pixels PX connected to the signal lines and arranged substantially in a matrix form when viewed from the equivalent circuit. As shown in FIG. 10, the liquid crystal panel assembly 300 includes lower and upper panels 100 and 200 facing each other and a liquid crystal layer 3 interposed therebetween.

The signal lines G1 to Gn and D1 to Dm include a plurality of gate lines G1 to Gn that transfers a gate signal (also referred to as a "scan signal') and a plurality of data lines D1 to Dm that transfers data voltage. The gate lines G1 to Gn extend substantially in a row direction and are substantially parallel to each other, and the data lines D1 to Dm extend substantially in a column direction and are substantially parallel to each other.

Each of the pixels PX, e.g., a pixel PX connected to an i-th gate line G1 and a j-th data line Dj, includes a switching element Q connected to corresponding signal lines G1 and Dj, and a liquid crystal capacitor Clc and a storage capacitor Cst connected to the corresponding signal lines. In an exemplary embodiment, the storage capacitor Cst may be omitted.

The switching element Q is a 3-terminal element, e.g., a thin film transistor, provided on the lower panel 100. A control terminal of the switching element Q is connected to a corresponding gate line G1, an input terminal is connected to a corresponding data line Dj, and an output terminal is connected to the liquid crystal capacitor Clc and the storage capacitor Cst. The thin film transistor may contain polycrystalline silicon or amorphous silicon.

The liquid crystal capacitor Clc is defined by a pixel electrode 191 of the lower panel 100 and a common electrode 270 of the upper panel 200 as two terminals thereof and the liquid crystal layer 3 between the two electrodes 191 and 270 serves as a dielectric material. The pixel electrode 191 is connected with the switching element Q and the common electrode 270 is disposed on a front surface of the upper panel 200 and receives the common voltage Vcom. In an alternative exemplary embodiment, unlike an exemplary embodiment shown in FIG. 10, the common electrode 270 may be provided on the lower panel 100. In such an embodiment, at least one of the two electrodes 191 and 270 may have a linear or rod shape.

The storage capacitor Cst supports the liquid crystal capacitor Clc. In an exemplary embodiment, the storage capacitor Cst may be defined by an additional signal line (not shown) and the pixel electrode 191 that are provided on the lower panel 100 and overlapping each other with an insulator interposed therebetween, and predetermined voltage, e.g., the common voltage Vcom may be applied to the additional signal line. In an alternative exemplary embodiment, the storage capacitor Cst may be defined by the pixel electrode 191 overlapping a gate line of a neighboring pixel with the insulator interposed therebetween.

In an exemplary embodiment, each pixel PX uniquely displays one of primary colors (spatial division) to display a color image or each pixel PX alternately displays the primary colors according to the time (temporal division) to recognize a desired color through the spatial and temporal sum of the primary colors to display a color image. In an exemplary embodiment, the primary colors may include three primary colors of red, green and blue. FIG. 10 shows an exemplary embodiment of a pixel using the spatial division. In such an embodiment, each pixel PX includes a color filter 230 to display one of the primary colors in the region of the upper panel 200 corresponding to the pixel electrode 191. In an exemplary embodiment, three pixels PX that display red, green and blue, respectively form one dot that displays one color. In an exemplary embodiment, the color filter 230 may be placed over or below the pixel electrode 191 of the lower panel 100.

At least one polarizer (not shown) that polarizes light may be provided on an outer surface of the liquid crystal panel assembly 300.

Referring back to FIG. 9, the gray voltage generator 800 generates two pairs of gray voltage sets associated with transmittance of the pixel PX. One pair of the two pairs of gray voltage sets has a positive value with respect to the common voltage Vcom, and the other pair has a negative value with respect to the common voltage Vcom. The number of gray voltages included in one pair of gray voltage sets generated by the gray voltage generator 800 may be the same as the number of grays to be displayed by the liquid crystal display.

The data driver 500 is connected with the data lines D1 to Dm of the liquid crystal panel assembly 300, and selects the gray voltage from the gray voltage generator 800 and applies the selected gray voltage to the data lines D1 to Dm as the data voltage.

The gate driver 400 applies the gate signal including the gate-on voltage Von and the gate-off voltage Voff to the gate lines G1 to Gn.

In an exemplary embodiment, each of the elements e.g., the gate driver 400, the data driver 500, the signal controller 600 and the gray voltage generator 800, may be integrated on the liquid crystal panel assembly 300 together with the signal lines G1 to Gn and D1 to Dm and the switching element Q. In an alternative exemplary embodiment, the elements 400, 500, 600 and 800 may be mounted directly on the liquid crystal panel assembly 300 in the form of at least one integrated circuit chip, mounted on a flexible printed circuit film (not shown) to be attached to the liquid crystal panel assembly 300 in the form of a tape carrier package ("TCP"), or mounted on an additional printed circuit board (not shown). In another alternative exemplary embodiment, the elements 400, 500, 600 and 800 may be integrated as a single chip. In such an embodiment, at least one of the elements 400, 500, 600 and 800 or at least one circuit element configuring the elements 400, 500, 600 and 800 may be positioned outside the single chip.

Hereinafter, an operation of the liquid crystal display will be described in detail.

The signal controller 600 receives input image signals R, G and B and input control signals that control the display from an external device, e.g., a graphic controller (not shown). The input image signals R, G and B include luminance information of each pixel PX and the luminance has a predetermined number, e.g., 1024 ($=2^{10}$), 256 ($=2^{8}$), or 64 ($=2^{6}$) grays. In an exemplary embodiment, the input control signals may include a vertically synchronization signal Vsync and a horizontal synchronization signal Hsync, a main clock MCLK and a data enable signal DE.

The signal controller 600 generates and appropriately processes an output image signal DAT based on the input image signals R, G and B and the input control signals and generates a gate control signal CONT1, a data control signal CONT2, and a lighting control signal CONT3. Thereafter, the signal controller 600 outputs the gate control signal CONT1 to the gate driver 400, and outputs the data control signal CONT2 and the processed output image signal DAT to the data driver 500.

The gate control signal CONT1 includes a scan start signal STV, which directs a scan start, and at least one clock signal, which controls an output cycle of the gate-on voltage Von. The gate control signal CONT1 may further include an output enable signal OE that limits a time for maintaining the gate-on voltage Von.

The data control signal CONT2 includes a horizontal synchronization start signal STH indicating a transmission start of the output image signal DAT for one group of pixels PX, a load signal LOAD that directs the application of the data voltage to the liquid crystal panel assembly 300, and a data cock signal HCLK. The data control signal CONT2 may further include an inversion signal RVS that inverts a voltage polarity (hereinafter, referred to as a "polarity of the data signal" by abbreviating the "voltage polarity of the data signal to the common voltage) of the data voltage to the common voltage Vcom.

In response to the data control signal CONT2 from the signal controller 600, the data driver 500 receives a digital output image signal DAT for one group of pixels PX, and selects the gray voltage corresponding to each digital output image signal DAT, and converts the digital output image signal DAT into analog data voltage and applies the analog data voltage to the corresponding data lines D1 to Dm.

The gate driver 400 applies the gate-on voltage Von to the gate lines G1 to Gn to turn on the switching element Q connected to the gate lines G1 to Gn in response to the gate control signal CONT1 from the signal controller 600. Then, the data voltage applied to the data lines D1 to Dm is applied to the corresponding pixel PX through the switching element Q that is turned on.

A difference between the data voltage applied to the pixel PX and the common voltage Vcom is the charge voltage of the liquid crystal capacitor Clc, i.e., pixel voltage. Orientations of liquid crystal molecules vary depending on the magnitude of the pixel voltage, and thus, polarization of light passing through the liquid crystal layer varies. The variation of the polarization is displayed as variation of transmittance of light by the polarizer on the panel assembly 300, and thus, the pixel PX displays luminance displayed by the gray of the image signal DAT.

By repetitively performing the process during each unit horizontal period (also referred to as"1H" and the same as one period of the horizontal synchronization signal Hsync and the data enable signal DE), the gate-on voltage Von is applied sequentially to all the gate lines G1 to Gn, and the data voltage is applied to all the pixels PX to display an image of one frame.

When one frame ends, a subsequent frame starts and a state of the inversion signal RVS applied to the data driver 500 is controlled such that the polarity of the data voltage applied to each pixel PX is opposite to the polarity of the data voltage applied thereto in the previous frame ("frame inversion"). In such an embodiment, even within one frame, the polarity of the data voltage that flows through one data line is changed by the inversion signal RVS (e.g., row inversion and dot inversion) or even the polarities of the data voltages applied to one pixel row may be different from each other (e.g., column inversion and dot inversion).

According to the exemplary embodiments of the invention, a liquid crystal display drives a data driver by a column inversion driving method or a 3-column inversion driving method without increasing the size of the data driver.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A liquid crystal display, comprising:

a plurality of pixels;

a plurality of data lines connected to the plurality of pixels;

a data driver connected to the plurality of data lines, wherein the data driver supplies a data voltage to the plurality of data lines, wherein the data driver comprises:

a data latch which outputs input image data in response to image data corresponding to six pixels of the plurality of pixels connected to six neighboring data lines of the plurality of data lines; and a digital-to-analog converting unit comprising:

a positive digital-to-analog converter which generates a positive data voltage in response to the input image data; and a negative digital-to-analog converter which generates a negative data voltage in response to the input image data, wherein when the image data corresponding to the six pixels are represented by 1, 2, 3, 4, 5 and 6 based on a sequence of the six neighboring data lines, the data latch rearranges the sequence of the image data corresponding to the 6 pixels to a sequence of 1, 4, 2, 5, 3 and 6 for each sequence of six neighboring data lines of the plurality of data lines, the data driver thereby configured to be driven by a 3-column inversion driving method;

a multiplexing unit connected to the digital-to-analog converting unit and the plurality of data lines; and a demultiplexing unit connected between the data latch and the digital-to-analog converting unit, wherein the multiplexing unit receives the positive data voltage and the negative data voltage from the digital-to-analog converting unit selects one of the positive data voltage and the negative data voltage, and supplies the selected one of the positive data voltage and the negative data voltage to the plurality of data lines, and wherein the demultiplexing unit selectively outputs the input image data to one of the positive digital-to-analog converter and the negative digital-to-analog converter.

2. The liquid crystal display of claim 1, wherein each of the six pixels corresponds to one of three different colors.

3. The liquid crystal display of claim 2, wherein the data latch rearranges a sequence of the image data for the six pixels such that the input image data of a same color are adjacent to each other.

4. The liquid crystal display of claim 3, wherein the three different colors include red, green and blue.

5. The liquid crystal display of claim 1, wherein the multiplexing unit selects one of the positive data voltage and the negative data voltage based on a selection signal.

6. The liquid crystal display of claim 5, wherein the selection signal comprises a first selection signal which controls an inversion driving method of the data driver and a second selection signal which controls a sequence of polarities.

7. The liquid crystal display of claim 6, wherein the inversion driving method of the data driver is a column inversion driving method or a 3-column inversion driving method.

8. The liquid crystal display of claim 1, wherein the demultiplexing unit selectively outputs the input image data based on a selection signal.

9. The liquid crystal display of claim 1, wherein the demultiplexing unit comprises a first demultiplexer, a second demultiplexer, a third demultiplexer, a fourth demultiplexer, a fifth demultiplexer and a sixth demultiplexer, the digital-to-analog converting unit comprises a first digital-to-analog converter, a second digital-to-analog converter, a third digital-to-analog converter, a fourth digital-to-analog converter, a fifth digital-to-analog converter and a sixth digital-to-analog converter, the multiplexing unit comprises a first multiplexer, a second multiplexer, a third multiplexer, a fourth multiplexer, a fifth multiplexer and a sixth multiplexer, each of the first digital-to-analog converter, the third digital-to-analog converter and the fifth digital-to-analog converter is the positive digital-to-analog converter, and each of the second digital-to-analog converter, the fourth digital-to-analog converter and the sixth digital-to-analog converter is the negative digital-to-analog converter.

10. The liquid crystal display of claim 9, wherein each of the first demultiplexer and the second demultiplexer is connected to the first digital-to-analog converter and the second digital-to-analog converter, each of the third demultiplexer and the fourth demultiplexer is connected to the third digital-to-analog converter and the fourth digital-to-analog converter, and each of the fifth demultiplexer and the sixth demultiplexer is connected to the fifth digital-to-analog converter and the sixth digital-to-analog converter.

11. The liquid crystal display of claim 10, wherein the first multiplexer, the second multiplexer, the third multiplexer, the fourth multiplexer, the fifth multiplexer and the sixth multiplexer are connected to the first data line, the second data line, the third data line, the fourth data line, the fifth data line and the sixth data line, respectively.

12. The liquid crystal display of claim 11, wherein each of the first multiplexer and the fourth multiplexer are connected to the first digital-to-analog converter and the second digital-to-analog converter, each of the second multiplexer and the fifth multiplexer are connected to the third digital-to-analog converter and the fourth digital-to-analog converter, and each of the third multiplexer and the sixth multiplexer are connected to the fifth digital-to-analog converter and the sixth digital-to-analog converter.

13. A liquid crystal display, comprising:

a plurality of pixels;

a plurality of data lines connected to the plurality of pixels; and a data driver connected to the plurality of data lines, wherein the data driver supplies a data voltage to the plurality of data lines, wherein the data driver comprises:

a data latch which outputs input image data in response to image data corresponding to the plurality of pixels, wherein the data latch rearranges a sequence of the image data; and a digital-to-analog converting unit comprising:

a positive digital-to-analog converter which generates a positive data voltage in response to the input image data;

a negative digital-to-analog converter which generates a negative data voltage in response to the input image data;

a multiplexing unit connected to the digital-to-analog converting unit and the plurality of data lines, the multiplexing unit receives the positive data voltage and the negative data voltage from the digital-to-analog converting unit, selects one of the positive data voltage and the negative data voltage, and supplies the selected one of the positive data voltage and the negative data voltage to the plurality of data lines, the multiplexing unit selects one of the positive data voltage and the negative data voltage based on a selection signal; and a demultiplexing unit connected between the data latch and the digital-to-analog converting unit, the demultiplexing unit selectively outputs the input image data to one of the positive digital-to-analog converter and the negative digital-to-analog converter.

14. The liquid crystal display of claim 13, wherein the demultiplexing unit selectively outputs the input image data based on the selection signal.

15. The liquid crystal display of claim 13, wherein the selection signal comprises a first selection signal which controls an inversion driving method of the data driver and a second selection signal which controls a sequence of polarities.

16. The liquid crystal display of claim 15, wherein the inversion driving method of the data driver is a column inversion driving method or a 3-column inversion driving method.

17. The liquid crystal display of claim 13, wherein the demultiplexing unit comprises a first demultiplexer, a second demultiplexer, a third demultiplexer, a fourth demultiplexer, a fifth demultiplexer and a sixth demultiplexer, the digital-to-analog converting unit comprises a first digital-to-analog converter, a second digital-to-analog converter, a third digital-to-analog converter, a fourth digital-to-analog converter, a fifth digital-to-analog converter and a sixth digital-to-analog converter, the multiplexing unit comprises a first multiplexer, a second multiplexer, a third multiplexer, a fourth multiplexer, a fifth multiplexer and a sixth multiplexer, each of the first digital-to-analog converter, the third digital-to-analog converter and the fifth digital-to-analog converter is the positive digital-to-analog converter, and each of the second digital-to-analog converter, the fourth digital-to-analog converter and the sixth digital-to-analog converter is the negative digital-to-analog converter.

18. The liquid crystal display of claim 17, wherein each of the first demultiplexer and the second demultiplexer is connected to the first digital-to-analog converter and the second digital-to-analog converter, each of the third demultiplexer and the fourth demultiplexer is connected to the third digital-to-analog converter and the fourth digital-to-analog converter, and each of the fifth demultiplexer and the sixth demultiplexer is connected to the fifth digital-to-analog converter and the sixth digital-to-analog converter.

19. The liquid crystal display of claim 18, wherein the first multiplexer, the second multiplexer, the third multiplexer, the fourth multiplexer, the fifth multiplexer and the sixth multiplexer are connected to the first data line, the second data line, the third data line, the fourth data line, the fifth data line and the sixth data line, respectively.

20. The liquid crystal display of claim 19, wherein each of the first multiplexer and the fourth multiplexer are connected to the first digital-to-analog converter and the second digital-to-analog converter, each of the second multiplexer and the fifth multiplexer are connected to the third digital-to-analog converter and the fourth digital-to-analog converter, and each of the third multiplexer and the sixth multiplexer are connected to the fifth digital-to-analog converter and the sixth digital-to-analog converter.

* * * * *